US005727848A

United States Patent [19]

Gazard

[11] Patent Number: 5,727,848

[45] Date of Patent: Mar. 17, 1998

[54] COMPUTER WORK STATION CHAIR

[76] Inventor: David Gazard, 4242 Henning Dr., Concord, Calif. 94521

[21] Appl. No.: 730,622

[22] Filed: Oct. 21, 1996

[51] Int. Cl.[6] ..... A47C 7/50

[52] U.S. Cl. ..... 297/423.36; 297/423.34; 297/423.24; 297/284.8

[58] Field of Search ..... 297/423.36, 423.24, 297/423.34, 284.8

[56] References Cited

U.S. PATENT DOCUMENTS

| | | | |
|---|---|---|---|
| 21,562 | 9/1858 | Holmes | 297/284.8 |
| 335,815 | 2/1886 | Hogan | 297/423.24 X |
| 390,477 | 10/1888 | Hogan | 297/423.24 |
| 1,542,508 | 6/1925 | Koenigkramer | 297/423.36 X |
| 2,571,080 | 10/1951 | Watter | 297/426.36 |
| 2,604,140 | 7/1952 | Bursey | 297/423.36 X |
| 3,464,754 | 9/1969 | Gottfried et al. | 297/284.8 |
| 3,851,870 | 12/1974 | Cook | 297/423.24 X |
| 4,647,066 | 3/1987 | Walton | 297/284.8 X |
| 5,582,464 | 12/1996 | Maymon | 297/423.26 X |

FOREIGN PATENT DOCUMENTS

| | | | |
|---|---|---|---|
| 2250 | 2/1886 | United Kingdom | 297/423.24 |

*Primary Examiner*—Peter M. Cuomo
*Assistant Examiner*—David E. Allred

[57] ABSTRACT

A computer work station chair including a base portion that is supported by a plurality of wheels. Also, included is a back rest that has a proximal side, a distal side, and a bottom side. The distal side of the back rest has a lumbar adjustment knob for adjustment of the proximal side. Included is a seat support that has a top side with a seat cushion; a bottom side with a support column; and a right side with a locking lever. The seat support supports the back rest with a frame portion. Additionally, included is a swivel that extends from the base and is positioned around the support column. Lastly, a foot rest that has a pair of side portions with a foot portion is included. One of the side portions is coupled to an extension bar that is coupled to the seat support.

1 Claim, 3 Drawing Sheets

COMPUTER WORK STATION CHAIR

BACKGROUND OF THE INVENTION

1. Field of the Invention

The present invention relates to a computer work station chair and more particularly pertains to allowing computer users to sit for very long periods of time in a chair that has a pedestal for foot positioning to aid the user in maintaining proper posture during the sitting period, and further preventing back strain when sitting for a long period of time at the computer.

2. Description of the Prior Art

The use of chairs is known in the prior art. More specifically, chairs heretofore devised and utilized for the purpose of sitting in are known to consist basically of familiar, expected, and obvious structural configurations, notwithstanding the myriad of designs encompassed by the crowded prior art which has been developed for the fulfillment of countless objectives and requirements.

By way of example, U.S. Pat. No. Des. 343,067 to Pass discloses an adjustable computer chair. U.S. Pat. No. 5,246,266 to Ostergaard discloses a chair. U.S. Pat. No. 5,120,107 to Rogers, Jr. discloses a recliner chair. U.S. Pat. No. 5,011,227 to van Hekken and Latond discloses an adjustable footrest for a chair. U.S. Pat. No. 4,348,051 to Boucher discloses a seat with adjustable foot-rest. U.S. Pat. No. Des. 252,781 to Ball discloses a secretarial arm chair. U.S. Pat. No. 4,059,305 to Ammirata discloses a seat and foot rest tilting chair. Lastly, U.S. Pat. No. 3,858,938 to Kristensson and Ridder discloses a chair having leg and foot supporting means.

While these devices fulfill their respective, particular objectives and requirements, the aforementioned patents do not describe computer work station chair that provides a chair for the prevention of back strain, reduction of poor circulation, and fatigue when the chair, having a lumbar adjustment and a pedestal for feet placement, is used by a person having to sit at a computer and work for long periods of time.

In this respect, the computer work station chair according to the present invention substantially departs from the conventional concepts and designs of the prior art, and in doing so provides an apparatus primarily developed for the purpose of allowing computer users to sit for very long periods of time in a chair that has a pedestal for foot positioning to aid the user in maintaining proper posture during the sitting period, and further preventing back strain when sitting for a long period of time at the computer.

Therefore, it can be appreciated that there exists a continuing need for a new and improved computer work station chair which can be used for allowing computer users to sit for very long periods of time in a chair that has a pedestal for foot positioning to aid the user in maintaining proper posture during the sitting period, and further preventing back strain when sitting for a long period of time at the computer. In this regard, the present invention substantially fulfills this need.

SUMMARY OF THE INVENTION

In view of the foregoing disadvantages inherent in the known types of chairs now present in the prior art, the present invention provides an improved computer work station chair. As such, the general purpose of the present invention, which will be described subsequently in greater detail, is to provide a new and improved computer work station chair and method which has all the advantages of the prior art and none of the disadvantages.

To attain this, the present invention essentially comprises a base portion that is supported by a plurality of coaster-type wheels. The base portion is positioned on a receiving surface. Also, included is a back rest that has a proximal side, a distal side, and a bottom side. The proximal side of the back rest has a cushion. The distal side of the back rest has a lumbar adjustment knob that extends therefrom. The lumbar adjustment knob is rotatable clockwise and counter-clockwise to adjust the cushion behind a lumbar region of a persons's back. Included is a generally rectangular seat support. The seat support has a top side, a bottom side, and a right side therebetween. The seat support supports the back rest with a rigid frame portion. The top side of the seat support has a seat cushion. The bottom side of the seat support has a support column extending downwardly therefrom. Additionally, a cylindrical swivel is positioned around the support column and extends upwardly from the base. The swivel is capable of allowing the support column to rotate three hundred and sixty degrees therein. Rotation of the swivel allows the chair to be rotated. Lastly, a generally rectangular foot rest is included. The pedestal has a pair of side portions with a foot portion therebetween. One of the side portions is coupled to an extension bar. One of the side portions has a pull-out knob for making angular adjustments of the foot rest with respect to the extension bar. Furthermore, the extension bar has a first extent and a second extent. The first extent has a first end that is coupled to the foot rest by a hexnut. The second extent has a second end that is coupled to the right side of the seat support. The second extent is capable of supporting the extension bar and the foot rest above the base of the chair. The second extent is capable of slidable movement within the first extent of the extension bar to provide the extension bar with an increasing and decreasing length.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved computer work station chair which has all of the advantages of the prior art chairs and none of the disadvantages.

It is another object of the present invention to provide a new and improved computer work station chair which may be easily and efficiently manufactured and marketed.

It is further object of the present invention to provide a new and improved computer work station chair which is of durable and reliable constructions.

An even further object of the present invention is to provide a new and improved computer work station chair which is susceptible of a low cost of manufacture with regard to both materials and labor, and which accordingly is then susceptible of low prices of sale to the consuming public, thereby making such computer work station chair economically available to the buying public.

Even still another object of the present invention is to provide a computer work station chair for allowing computer users to sit for very long periods of time in a chair that has a pedestal for foot positioning to aid the user in maintaining proper posture during the sitting period, and further preventing back strain when sitting for a long period of time at the computer.

Lastly, it is an object of the present invention to provide a new and improved computer work station chair including a base portion that is supported by a plurality of wheels. Also, included is a back rest that has a proximal side, a distal side, and a bottom side. The distal side of the back rest has a lumbar adjustment knob for adjustment of the proximal side. Included is a seat support that has a top side with a seat cushion; a bottom side with a support column; and a right side with a locking lever. The seat support supports the back rest with a frame portion. Additionally, included is a swivel that extends from the base and is positioned around the support column. Lastly, a pedestal that has a pair of side portions with a foot portion is included. One of the side portions is coupled to an extension bar that is coupled to the seat support.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
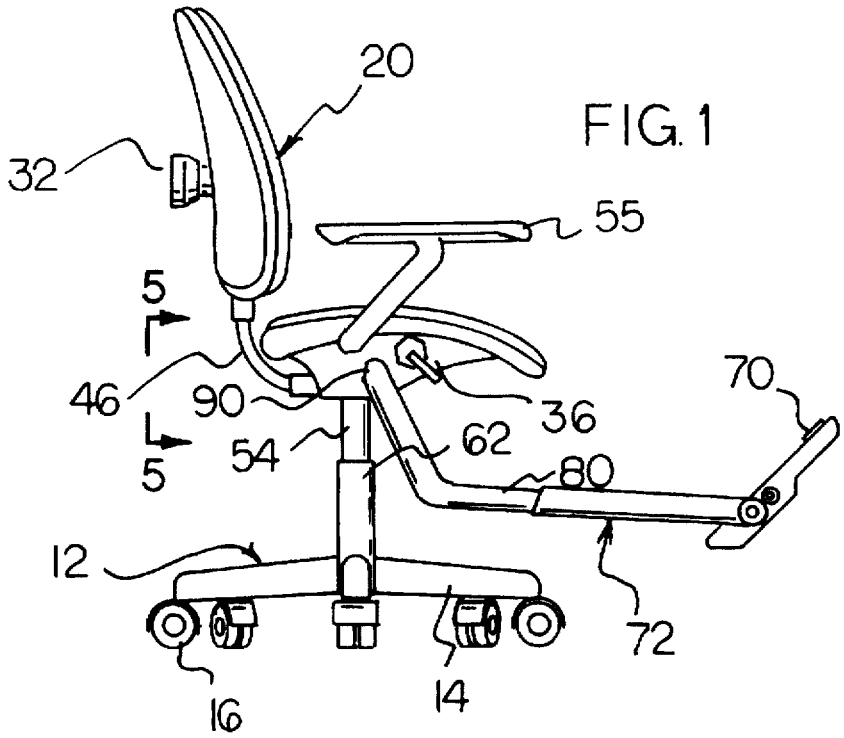
FIG. 1 is a perspective view of the preferred embodiment of the computer work station chair constructed in accordance with the principles of the present invention.

With reference now to the drawings, and in particular to FIG. 1 thereof, the preferred embodiment of the new and improved computer work station chair embodying the principles and concepts of the present invention and generally designated by the reference numeral 10 will be described.

The present invention, the computer work station chair 10 is comprised of a plurality of components. Such components in their broadest context include a chair, a lumbar adjustment knob, a height adjustment handle, and a pedestal. Such components are individually configured and correlated with respect to each other so as to attain the desired objective.

Specifically, the present invention includes a base portion 12. The base portion has a plurality of legs. The legs 14 are formed of metal or wood. In the present invention, the legs are formed of metal. The base portion is supported by a plurality of caster-type wheels 16 that are attached to the legs. Each wheel is a dual-wheel caster wheel. The number of wheels coincides with the number of legs supporting the base portion. The base portion of the present invention is a five star base with five legs. The wheels of the base portion are positioned on a receiving surface. The wheels, as shown in FIG. 1, are preferably formed of metal or a rigid plastic.

Figure 2:
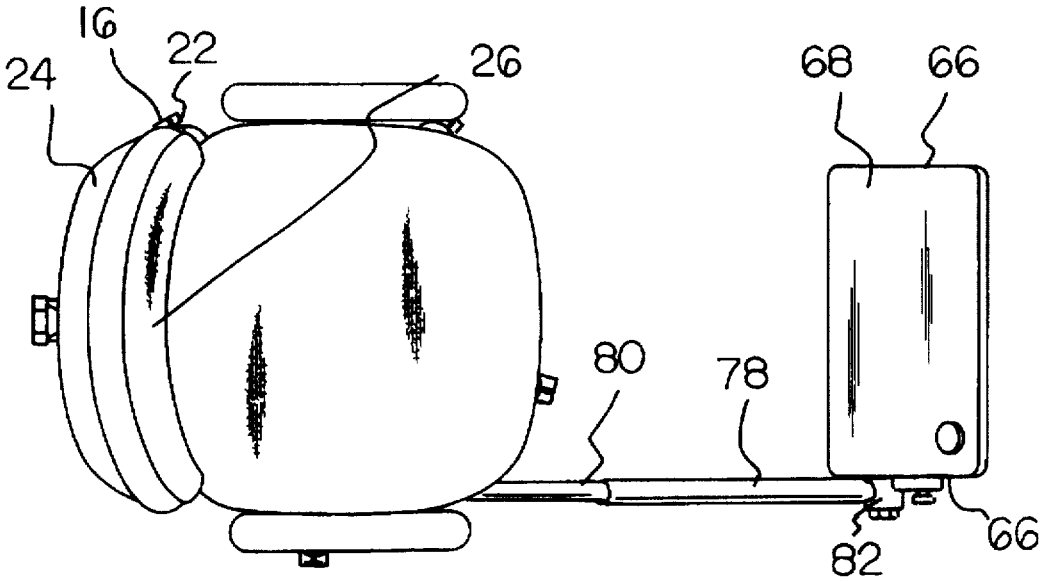
FIG 2. is a top plan view of the present invention as shown in FIG. 1.
Figure 3:
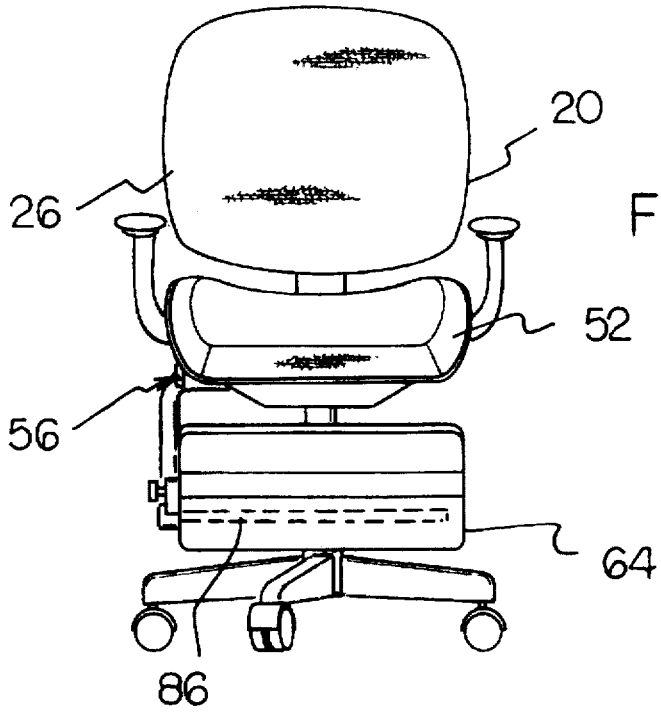
FIG 3. is a frontal view of the present invention as shown in FIG. 1.

Included is a back rest 20. The back rest, as shown in FIG. 2, has a proximal side 22, a distal side 24, and a bottom side, as shown in FIG. 1. The proximal side of the back rest has a cushion 26. The cushion, as shown in FIG. 3, is formed of a foam plastic and covered with a fabric. The fabric may be formed of natural of man-made materials. The distal side of the back rest has a lumbar adjustment knob 32 that extends outwardly therefrom.

The lumbar adjustment knob, of FIG. 1, is rotatable clockwise and counter-clockwise to adjust the cushion behind a lumbar region of a person's back. Adjustment of the cushion allows the person's posture to be adjusted to the proper position. Having proper posture when sitting relieves a great deal of back strain on the person sitting in the chair.

Figure 5:
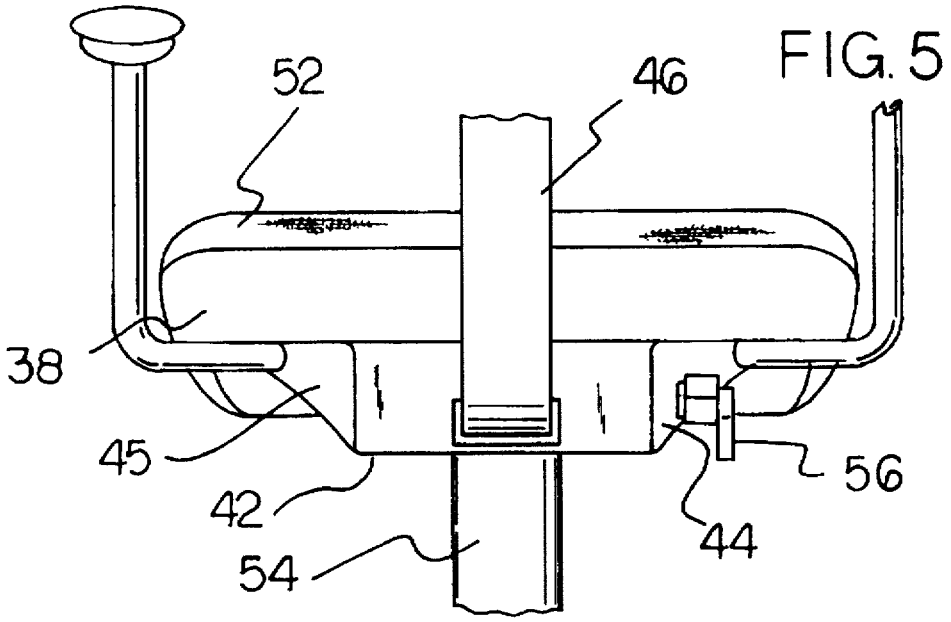
FIG 5. is a rear cut-away view of the seat support of the invention of FIG. 1.

As best illustrated in FIG. 5, a generally rectangular seat support 36 is provided. The seat support has a top side 38, a bottom side 42, a right side 44 and a left side 45. The seat support may be formed of a rigid plastic, such as, ployvinylchloride. The seat support supports the back rest with a rigid frame portion 46. The frame portion is a metal or metal alloy. The frame has a J-shape and is structured so as to not make contact with the person's body. The top side of the seat support has a seat cushion 52 thereon. The seat cushion is made of the same material as the cushion of the back rest.

Also, the seat cushion is covered in an identical fabric. The bottom side of the seat support has a support column 54 that extends downwardly therefrom. The support column is formed of metal and is cylindrical. The right and left side of the seat support each have an armrest 55 attached. The right side of the seat support has a locking lever 56 that extends slightly from the seat support. The locking lever 56 as shown in FIG. 5, is positioned within the seat support 36. The locking lever is rotatable within the seat support.

Additionally, a cylindrical swivel 62 is included. The swivel, as shown in FIG. 1, is positioned around the support column 54 and extends upwardly from the base 12. The swivel has the legs 14 attached. The swivel allows the support column 54 to rotate three hundred and sixty degrees within the swivel for rotating the chair about the swivel. The motion of the support column within the swivel is caused when a person sitting in the chair moves from side-to-side. The motion of the support column within the swivel allows the person to turn the chair away from the work area without having to push the chair back from the work area before getting out of the chair.

Lastly, a generally rectangular foot rest 64, as shown in FIG. 3, is provided. The foot rest has a pair of side portions 66 with a foot portion 68, as shown in FIG. 2. The foot portion has an air release button 70. One of the side portions is coupled to an extension bar 72. One of the side portions has a pull-out knob 74 for making angular adjustments of the pedestal with respect to the extension bar.

Figure 4:
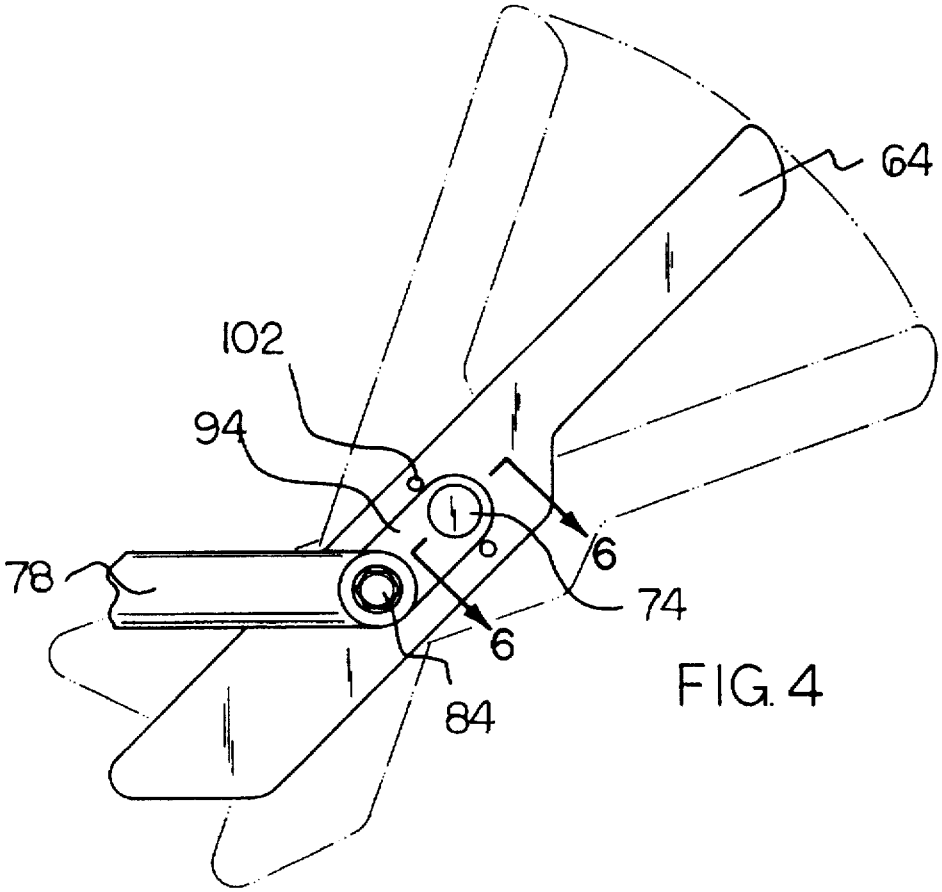
FIG 4. is an operable view of the foot rest of the invention of FIG. 1.

Furthermore, the extension bar 72 has a first extent 78 and a second extent 80. The first extent has a first end 82 that is coupled to the foot rest 64 by a hexnut 84. The hexnut is positioned around a support rod 86 that is positioned through the first end. The support rod is contained within the foot rest 64. The support rod allows the pedestal to swivel angularly along the first end of the first extent, as shown in FIG. 4.

The second extent has a second end 90 that is coupled to the right side of the seat support 36 when the support column 54 is in the swivel. The second end of the second extent is engaged by the locking lever 56 within the seat support. The locking lever engages the second end to hold the extension bar in a position while the chair is in use. The locking lever can be rotated away from the second end, to release the extension bar, for movement of the seat support away from the pedestal. The second end of the second extent supports the extension bar and the pedestal above the base 12 of the chair 10.

The second extent 80 is capable of slidable movement within the first extent 78 of the extension bar for providing the extension bar with an increasing and decreasing length. The air pressure created, when the second extent is slid into the first extent, passes into the foot rest 64 for release through, the air release button 70.

Figure 6:
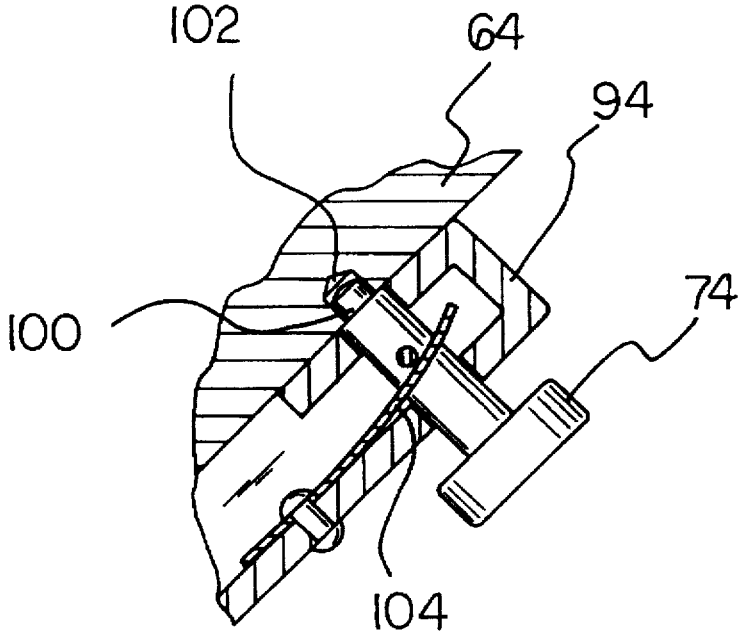
FIG. 6 sectional view taken along line 6—6 of FIG. 4.

The first extent 78 has a rectangular or oblong portion 94 extending at a sixty degree angle from the first end 82. As shown in FIG. 6, the pull-out knob 74 of the pedestal is positioned through the rectangular portion of the first end of the first extent 78. When the pull-out knob is pulled out, it allows the pedestal to be positioned at a variety of angles with respect to the extension bar. When the pull-out knob is pushed in the tip 100 of the pull-out knob is positioned in a notch 102 of the pedestal. The pull-out knob is secured in the notch by a bias spring 104 that is contained within the rectangular portion of the first extent.

The present invention is a computer work station chair that can be used by anyone who has to sit at a computer for long periods of time. The chair has a back rest with a lumbar adjustment knob attached thereto for adjusting the cushion on a proximal portion of the back rest.

Lastly, the chair has a pedestal that is attached to a support column of the chair by an extension bar. The extension bar allows the pedestal to be adjusted in accordance with the length necessary to fit the leg length of the chair user. The present invention prevents back strain, poor circulation, and fatigue by providing the various adjustment portions. The present invention is capable of remaining stationary while allowing the user of the chair to rotate away from the pedestal by a swivel portion that the support column is positioned in. To use the chair, a person sits down in the chair, rotates in the direction of the computer work area, position his/her foot on the pedestal, if the pedestal is not properly adjusted, the person would get out of the chair. Then adjust the angle of the pedestal by using the pull-out knob. Once the proper angle is reached, the person would sit back in the chair.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A new and improved computer workstation chair for relieving body stress and strain while sitting for long periods of time comprising in combination:

a base portion being supported by a plurality of dual-wheel caster wheels that support the base on a receiving surface;

a backrest having a proximal side, a distal side and a bottom side, the proximal side of the backrest having a cushion thereon, the distal side of the backrest having a lumbar adjustment knob extending therefrom, the lumbar adjustment knob rotating clockwise and counter clockwise for adjustment of the cushion behind a lumbar region of a person's back;

a generally rectangular seat support formed of a rigid plastic, the seat support having a top side, a bottom side and a right side therebetween, the seat support supporting the back rest by a J-shaped rigid frame portion, the top side of the seat support having a seat cushion thereon, the bottom side of the seat support having a support column extending therefrom, the right side of the seat support has a locking lever that extends from the seat support, the locking lever being positioned within the seat support and rotatable within the seat support;

a cylindrical swivel being positioned around the support column and extending upwardly from the base, the swivel allowing the support column to rotate 360 degrees within the swivel for rotation of the chair about the swivel;

a generally rectangular foot rest having a pair of side portions with a foot portion therebetween, one of the side portions coupled to an extension bar, one of the side portions having a pull out knob for making angular adjustments of the foot rest with respect to the extension bar;

the extension bar having a first extent and a second extent, the first extent having a first end coupled to the foot rest by a hexnut, the second extent having a second end coupled to the right side of the seat support, the second extent supporting the extension bar and pedestal above the base of the chair, the second extent being capable of slidable movement within the first extent of the extension bar for providing the extension bar with an increasing and decreasing length, wherein air pressure, created when the second extent is slid into the first extent, passes into the foot rest and is released by an air release button on said foot portion of said foot rest, and the first extent having an oblong portion extending at sixty degree angle from the first end, the pull-out knob of the pedestal being positioned through the oblong portion of the first end of the first extent, the pull-out knob, when pulled out, allowing the pedestal to be positioned at a variety of angles with respect to the extension bar, the pull-out knob, when pushed in being positioned within a notch of the foot rest and held therein by a bias spring.

* * * * *